US009288575B2

(12) United States Patent
Valeri et al.

(10) Patent No.: US 9,288,575 B2
(45) Date of Patent: Mar. 15, 2016

(54) SOUND AUGMENTATION SYSTEM TRANSFER FUNCTION CALIBRATION

(71) Applicant: GM GLOBAL TECHNOLOGY OPERATIONS LLC, Detroit, MI (US)

(72) Inventors: Frank C. Valeri, Novi, MI (US); Scott M. Reilly, Southfield, MI (US); James May, Milford, MI (US)

(73) Assignees: GM GLOBAL TECHNOLOGY OPERATIONS LLC, Detroit, MI (US); BOSE CORPORATION, Framingham, MA (US)

( * ) Notice: Subject to any disclaimer, the term of this patent is extended or adjusted under 35 U.S.C. 154(b) by 115 days.

(21) Appl. No.: 14/288,874

(22) Filed: May 28, 2014

(65) Prior Publication Data

US 2015/0350776 A1 Dec. 3, 2015

(51) Int. Cl.
*H04R 29/00* (2006.01)
*H04R 3/00* (2006.01)

(52) U.S. Cl.
CPC ..... *H04R 3/002* (2013.01); *H04R 29/00* (2013.01); *H04R 2430/00* (2013.01); *H04R 2499/13* (2013.01)

(58) Field of Classification Search
None
See application file for complete search history.

(56) References Cited

U.S. PATENT DOCUMENTS 5,410,604 A * 4/1995 Saito ..... G10K 11/1786 381/71.12
5,426,703 A * 6/1995 Hamabe ..... G10K 11/1786 381/71.12
2010/0014688 A1* 1/2010 Mollon ..... H04R 5/02 381/86
2010/0150375 A1* 6/2010 Buck ..... G10L 25/78 381/94.1
2010/0215190 A1* 8/2010 Itou ..... G10K 11/1786 381/94.2
2013/0156213 A1* 6/2013 Pan ..... H04R 29/00 381/71.4
2014/0010380 A1* 1/2014 Usher ..... H04R 29/00 381/58

OTHER PUBLICATIONS

Mark R. Every, et al., SAE International, "A Software Library for Active Control of Automotive Engine Noise," May 13, 2013, 8 pages.
QNX Acoustics for Active Noise Control, retrieved from the internet: http://www.qnx.com/products/anc/index.html, Apr. 15, 2014, 3 pages.

* cited by examiner

*Primary Examiner* — Thang Tran
(74) *Attorney, Agent, or Firm* — Cantor Colburn LLP

(57) ABSTRACT

A vehicle system is provided that includes a sound augmentation system with a sound augmentation generator that produces an augmented audio output to drive at least one audio output based on a transfer function. The vehicle system also includes a sound augmentation system health monitor that determines a current performance level of the sound augmentation system based on at least one audio input and a feedback of the augmented audio output, and triggers a transfer function update prompt based on a difference between the current performance level and an expected performance level being at a threshold level. A user interface outputs the transfer function update prompt and receives a transfer function calibration request in response to the transfer function update prompt. A transfer function calibration module drives a calibration sequence on at least one audio output and monitors at least one audio input to determine an updated transfer function.

20 Claims, 4 Drawing Sheets

SOUND AUGMENTATION SYSTEM TRANSFER FUNCTION CALIBRATION

FIELD OF THE INVENTION

Exemplary embodiments of the invention are related to systems and methods for transfer function calibration of a sound augmentation system.

BACKGROUND

To enhance driver and passenger experience, some vehicles include a sound augmentation system, such as an active noise cancellation system. An active noise cancellation system attempts to reduce or eliminate unwanted sound by the addition of another sound source specifically designed to cancel or substantially reduce the unwanted sound. A sound augmentation system in a vehicle may include one or more microphones to detect sounds, an amplifier, and one or more speakers to output augmented sounds. As components in a vehicle age, they may exhibit changes in audio characteristics. For example, changes over time to components such as speakers, seals, trim attachments, headliner/microphone interface, etc. can impact transfer function characteristics of a sound augmentation system. When transfer functions used by the sound augmentation system no longer accurately reflect the characteristics of the vehicle, effectiveness of noise cancellation can diminish.

Additionally, transfer functions used for a sound augmentation system can reflect tuning characteristics that are broadly defined for a group of vehicles in order to achieve stability across a number of build variations. These transfer functions can be effective but may not be optimized to reflect characteristics specific to individual vehicles. For example, variations in trim options, engine options, transmission options, and the like can result in different audio profiles for a particular vehicle make and model.

Accordingly, it is desirable to provide systems and methods for transfer function calibration of a sound augmentation system.

SUMMARY OF THE INVENTION

In one exemplary embodiment, a vehicle system is provided that includes a sound augmentation system with a sound augmentation generator coupled to at least one audio output. The sound augmentation generator produces an augmented audio output to drive the at least one audio output based on a transfer function. The vehicle system also includes a sound augmentation system health monitor coupled to at least one audio input and a feedback of the augmented audio output. The sound augmentation system health monitor determines a current performance level of the sound augmentation system based on the at least one audio input and the feedback of the augmented audio output, and triggers a transfer function update prompt based on a difference between the current performance level and an expected performance level being at a threshold level. The vehicle system further includes a user interface that outputs the transfer function update prompt and receives a transfer function calibration request in response to the transfer function update prompt. The vehicle system additionally includes a transfer function calibration module coupled to the at least one audio output and the at least one audio input. The transfer function calibration module drives a calibration sequence on the at least one audio output and monitors the at least one audio input to determine an updated transfer function in response to the transfer function calibration request.

In another exemplary embodiment, a method of transfer function calibration for a sound augmentation system in a vehicle is provided. A sound augmentation generator of a sound augmentation system produces an augmented audio output to drive at least one audio output in the vehicle based on a transfer function. A current performance level of the sound augmentation system is determined based on a feedback of the augmented audio output and at least one audio input. A transfer function update prompt is triggered based on a difference between the current performance level and an expected performance level being at a threshold level. A transfer function calibration request is monitored in response to the transfer function update prompt. In response to receiving the transfer function calibration request, a calibration sequence is driven on the at least one audio output while monitoring the at least one audio input to determine an updated transfer function.

In a further exemplary embodiment, a vehicle includes at least one audio output to a speaker and at least one audio input from a microphone. The vehicle also includes a sound augmentation system, a sound augmentation system health monitor, a user interface, a transfer function calibration module, and a wireless interface. The sound augmentation system includes a sound augmentation generator coupled to the at least one audio output. The sound augmentation generator produces an augmented audio output to drive the at least one audio output based on a transfer function. The sound augmentation system health monitor is coupled to the at least one audio input and a feedback of the augmented audio output. The sound augmentation system health monitor determines a current performance level of the sound augmentation system based on the at least one audio input and the feedback of the augmented audio output, and triggers a transfer function update prompt based on a difference between the current performance level and an expected performance level being at a threshold level. The user interface outputs the transfer function update prompt and receives a transfer function calibration request in response to the transfer function update prompt. The transfer function calibration module is coupled to the at least one audio output and the at least one audio input. The transfer function calibration module drives a calibration sequence on the at least one audio output and monitors the at least one audio input to determine an updated transfer function in response to the transfer function calibration request. The wireless interface transmits the updated transfer function to a data collection system.

The above features and advantages and other features and advantages of the invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
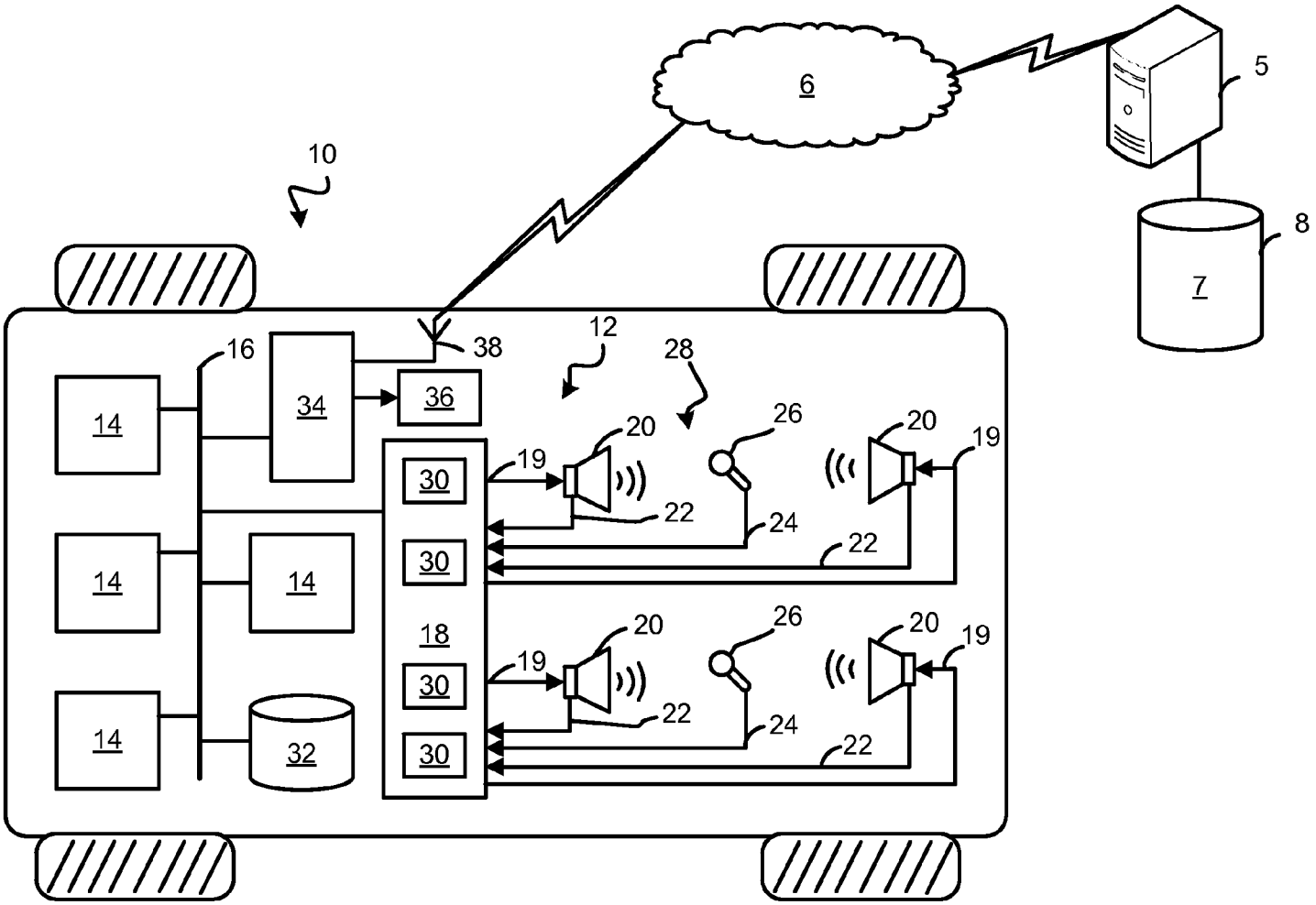
FIG. 1 is a schematic illustration of a vehicle including a system configured to perform sound augmentation in accordance with an exemplary embodiment.

The following description is merely exemplary in nature and is not intended to limit the present disclosure, its application or uses. It should be understood that throughout the drawings, corresponding reference numerals indicate like or corresponding parts and features. As used herein, the term module refers to processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

In accordance with an exemplary embodiment of the invention a vehicle is shown generally at 10 in FIG. 1. The vehicle 10 includes a vehicle system 12, which is also referred to as system 12. The vehicle system 12 includes a plurality of modules 14 coupled to a vehicle information bus 16. The modules 14 may support a number of specific functions for the vehicle 10, such as an engine control module, a transmission control unit, an anti-lock braking system, and body control modules for example. In the example of FIG. 1, the vehicle system 12 also includes an audio system 18 configured to perform sound augmentation.

The audio system 18, also referred to generally as system 18, drives at least one audio output 19 to one or more speakers 20. In the example of FIG. 1, the audio system 18 drives four audio outputs 19 to four speakers 20; however, it will be understood that there could be any number of speakers 20 in various distribution patterns in the vehicle 10. The audio system 18 may receive four audio output feedbacks 22 from the four speakers 20. The audio system 18 is also coupled to at least one audio input 24 from one or more microphones 26. In the example of FIG. 1, the audio system 18 receives two audio inputs 24 from two microphones 26, where each microphone 26 can be positioned proximate to a pair of the speakers 20 within the vehicle 10. A pairing 28 can be defined between one of the audio outputs 19 or speakers 20 and one of the audio inputs 24 or microphones 26. Each pairing 28 can be associated with a transfer function 30 that characterizes a relationship between the pairing 28 across a frequency range. Individual instances of the transfer function 30 can vary relative to each other based on placement of the speakers 20 and microphones 26 within the vehicle 10 as well as individual characteristics of each pairing 28 and the particular configuration of the vehicle 10. The transfer functions 30 and associated configuration data can initially reside in a data storage device 32, which may be incorporated within the audio system 18 or otherwise in communication with the audio system 18. In the example of FIG. 1, the data storage device 32 is coupled to the audio system 18 through the vehicle information bus 16. The audio system 18 may read and/or update data stored in the data storage device 32.

The audio system 18 can send and receive a variety of data on the vehicle information bus 16. The audio system 18 may receive data including vehicle conditions from one or more of the modules 14, indicating operating conditions of the vehicle 10. The audio system 18 can generate outputs on the vehicle information bus 16, such as alerts or prompts, to indicate when an update of one or more of the transfer functions 30 may be needed. Alerts or prompts can be sent from the audio system 18 to a vehicle health monitor 34, which also collects vehicle health data from the modules 14. The vehicle health monitor 34 can be coupled to a user interface 36 to display status messages and/or provide an interactive health and diagnostic service interface for the vehicle 10. The user interface 36 may also receive inputs, such as a transfer function calibration request, that can be sent to the audio system 18. A transfer function calibration request can be initiated by an operator of the vehicle 10 or a service technician in response to a transfer function update prompt. The transfer function calibration request can trigger a calibration procedure that drives a sequence of tones on one or more of the speakers 20 to determine one or more updated transfer functions. Any updated transfer functions can be transmitted with an identifier of the vehicle 10 or vehicle system 12 to a data collection system 5 via a communication network 6.

The data collection system 5 can be located external to the vehicle 10, for instance, at a remotely located data collection and processing center. The data collection system 5 can log vehicle data 7 in a database 8 for further analysis. The vehicle data 7 can be accumulated for multiple vehicles, including the vehicle 10. Collection of updated transfer functions in the vehicle data 7 can enable analysis to determine how they are performing and changing over time. The vehicle data 7 can improve understanding of regional issues, specific plant builds, and/or fleet characteristics.

The communication network 6 can include any type of wired and/or wireless communication, such as a code division multiple access (CDMA) data channel. In the example of FIG. 1, the vehicle 10 includes a wireless interface 38 to support wireless communication over the communication network 6. In an alternate embodiment, a history of updates to the transfer function 30 is stored locally within the vehicle 10 and transferred during a maintenance operation. For instance, a local diagnostic link (not depicted) can extract data from the vehicle 10, including a history of updates to the transfer function 30, which may then be relayed to the data collection system 5.

Although a particular arrangement is depicted within the vehicle 10, the scope of embodiments is not so limited. For example, various orientation and distribution patterns of the pairings 28 can be used in the vehicle 10, as well as various numbers of speakers 20 and microphones 26 with associated inputs and outputs. Furthermore, the audio system 18 can be subdivided into multiple systems or integrated within another component or system.

Figure 2:
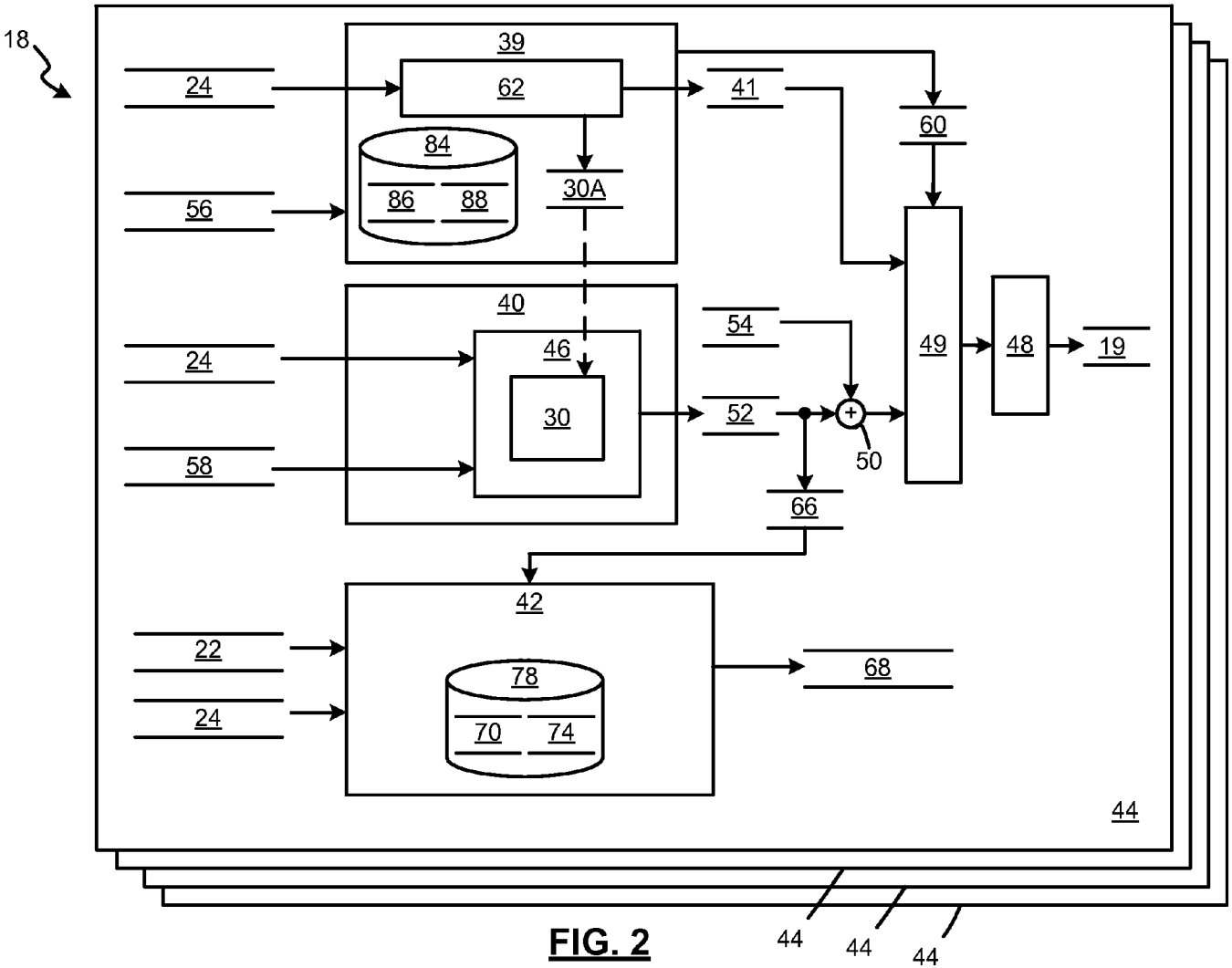
FIG. 2 is a dataflow diagram for a portion of the system of FIG. 1 in accordance with an exemplary embodiment.

FIG. 2 is a dataflow diagram of a portion of the audio system 18 of FIG. 1 in accordance with an exemplary embodiment. In the example of FIG. 2, a transfer function calibration module 39, a sound augmentation system 40, and a sound augmentation health monitor 42 are depicted in greater detail for one audio channel 44. In the example of FIG. 2, there are four audio channels 44, where each audio channel 44 drives an associated speaker 20 of FIG. 1. The sound augmentation system 40 includes a sound augmentation generator 46 coupled to at least one audio output 19. As depicted in FIG. 2, the sound augmentation generator 46 may be coupled to an audio output 19 through an amplifier 48, a multiplexer 49, and a summing junction 50. The summing junction 50 can combine an augmented audio output 52 produced by the sound augmentation generator 46 with a baseline audio output 54 of the audio system 18. For example, the baseline audio output 54 can be from a radio tuner, a compact disc player, a navigation system, an auxiliary source, another augmentation source, or the like.

The sound augmentation generator 46 produces the augmented audio output 52 to drive the at least one audio output 19 based in part on the transfer function 30 and a plurality of audio tuning parameters 58. The audio tuning parameters 58 may be received from the data storage device 32 of FIG. 1 as initial tuning states for the vehicle 10. The audio tuning parameters 58 can be locally buffered and adjusted to modify, for instance, gain and phase values for the augmented audio output 52.

The sound augmentation generator 46 can perform active noise cancellation by driving the augmented audio output 52 into an aligned gain and opposite phase relationship as a targeted noise frequency to cancel. In an active noise cancellation configuration, the sound augmentation generator 46 can establish a feedback loop relative to an audio input 24. The transfer function 30 can determine an overall shape of a frequency response relative to the audio input 24 and audio output 19 when the baseline audio output 54 is excluded. The transfer function 30 may model sound absorption and reflection properties of an interior of the vehicle 10 of FIG. 1 with respect to a pairing 28 of a microphone 26 and speaker 20 of FIG. 1.

As can be seen in FIG. 2, the sound augmentation health monitor 42 is coupled to at least one audio input 24 and a feedback 66 of the augmented audio output 52. The feedback 66 of the augmented audio output 52 is based on the augmented audio output 52 but need not be the exact value of the augmented audio output 52. For example, although depicted in FIG. 2 as a direct connection with the augmented audio output 52, in an alternate embodiment the feedback 66 can be captured at any downstream point from the augmented audio output 52, such as prior to or after the amplifier 48. The sound augmentation system health monitor 42 may also receive an audio output feedback 22 as a separate input. As can be appreciated, more feedback signals, such as separate instances of the feedback 66 and the audio output feedback 22 taken at different points may further enhance fault isolation.

In an exemplary embodiment, the sound augmentation system health monitor 42 compares the feedback 66 of the augmented audio output 52 to a level of the audio input 24 to determine a current performance level 70 of the sound augmentation system 40. The sound augmentation system health monitor 42 can determine a difference between the current performance level 70 of the sound augmentation system 40 and an expected performance level, and initiates an alert 68 upon determining that the difference is at a threshold level. The alert 68 may trigger a transfer function update prompt at the user interface 36 of FIG. 1.

A number of thresholds 74 can be defined for performance monitoring, including an expected performance level and a threshold level. The current performance level 70 and thresholds 74 may be stored in local storage 78. The current performance level 70 can be an instantaneous value or determined over a period of time. The expected performance level can be set to a value that is beyond the typical adjustment ability of the audio tuning parameters 58 but not at a complete failure level. Adjustments to the audio tuning parameters 58 may not adequately compensate for changes in the audio characteristics of the vehicle 10 beyond a certain range, which may result in noise levels noticeably less attenuated unless the audio environment of the vehicle 10 of FIG. 1 is re-characterized as an update to the transfer function 30. Depending upon implementation, the threshold level can be less than a minimum level or greater than a maximum level. For example, the threshold level can be defined as at or above a sound level where a transfer function update should be attempted when monitoring for sound reduction due to undesired noise cancellation performance. The sound augmentation system health monitor 42 can also monitor other feedback sources for undesired performance, such as a lower voltage at an audio output feedback 22 when a higher voltage is expected.

The transfer function calibration module 39 is coupled to at least one audio output 19 and at least one audio input 24. The transfer function calibration module 39 can drive a calibration sequence 41 on at least one audio output 19 and monitors at least one audio input 24 to determine an updated transfer function 30A in response to a transfer function calibration request 56. The transfer function calibration module 39 can set a calibration mode 60 to control a state of the multiplexer 49 to select between the calibration sequence 41 and an output of the summing junction 50. When the calibration mode 60 is active, the calibration sequence 41 is passed through the multiplexer 49 and the amplifier 48 to the audio output 19. Effects of the calibration sequence 41 are observed by calibration logic 62 via the audio input 24. The calibration logic 62 can calculate the updated transfer function 30A by characterizing a frequency response of the calibration sequence 41 observed at the audio input 24. The updated transfer function 30A can replace transfer function 30 in the sound augmentation generator 46.

Local storage 84 can store a transfer function update history 86 that can include past values of the transfer function 30 and the updated transfer function 30A. The local storage 84 can also include a baseline transfer function 88 that represents a factory default value for restoring the transfer function 30 in case an errant determination of the updated transfer function 30A occurs, for instance, due to additional environmental noise or other factors. The updated transfer function 30A can also be sent to the wireless interface 38 (FIG. 1) for transmission to the data collection system 5 (FIG. 1) along with an identifier of the vehicle 10/vehicle system 12 of FIG. 1.

Operation of the transfer function calibration module 39 is coordinated across the audio channels 44, such that when the calibration mode 60 is active for one audio output 19, the remaining audio outputs 19 are muted. Calibration can be initiated sequentially across multiple audio channels 44 or only performed to update a single audio channel 44. As part of a calibration process, additional system testing may be performed to ensure that system components are operable before modifying the transfer function 30. For example, open circuit and short circuit tests can be performed for the speaker 20 (FIG. 1), microphone 26 (FIG. 1), and amplifier 48. If these tests are successful, then calibration can proceed. Otherwise, if one or more of the open or short circuit tests are unsuccessful, a notification can be sent to the vehicle health monitor 34 of FIG. 1.

While the example of FIG. 2 is described relative to one audio channel 44, each of the audio channels 44 can operate in parallel within the vehicle 10 of FIG. 1. Accordingly, separate instances of the augmented audio output 52 are defined for each audio output 19. A single instance or separate instances of the sound augmentation system health monitor 42 operate in parallel on each of the separate instances of the augmented audio output 52, and separate instances of the alert 68 are defined for each of the audio outputs 19. Therefore, undesired performance of the transfer function 30 can be more reliably identified as associated with a particular component or pairing 28 (FIG. 1). Although the transfer function calibration module 39, the sound augmentation system 40, and the sound augmentation system health monitor 42 are depicted relative to a single audio channel 44, it will be understood that instances of the transfer function calibration module 39, the sound augmentation system 40, and the sound augmentation system health monitor 42 can be implemented that cover more than one audio channel 44, such as one instance to cover all of the audio channels 44.

Figure 3:
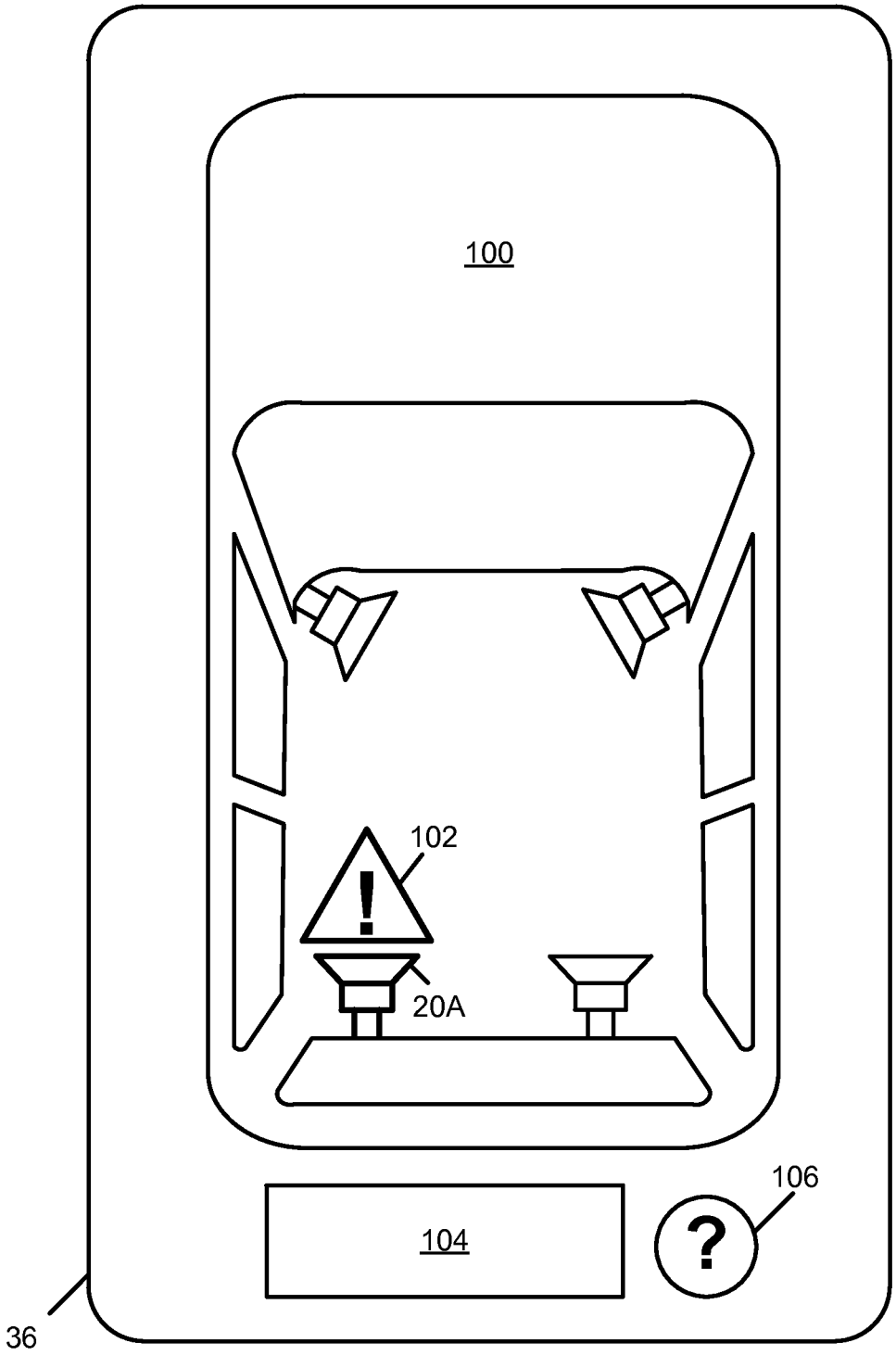
FIG. 3 is an example depiction of a user interface in accordance with an exemplary embodiment.

FIG. 3 is an example depiction of the user interface 36 of FIG. 1 in accordance with an exemplary embodiment. The user interface 36 may provide a graphical depiction 100 of the vehicle 10 of FIG. 1. Upon receiving the alert 68 of FIG. 2, the user interface 36 can provide visual and/or audio messages that identify potential issues. In the example of FIG. 3, a particular speaker 20A is highlighted with a warning 102. A description region 104 can provide further details about the warning 102. For example, the warning 102 can indicate an undesired condition of the speaker 20A with a suggested action provided in the description region 104. If testing performed by the audio system 18 indicates that speaker 20A is non-responsive, a message indicating that service is needed can be displayed in the description region 104 or elsewhere on the user interface. If the warning 102 is associated with the transfer function 30 (FIGS. 1 and 2) for the speaker 20A, rather than taking the vehicle 10 (FIG. 1) to a service location, the user interface 36 can output a transfer function update prompt 106 that enables a vehicle operator to initiate transfer function calibration. The user interface 36 can receive a transfer function calibration request 56 (FIG. 2) in response to the transfer function update prompt 106 and provide the transfer function calibration request 56 (FIG. 2) to an associated transfer function calibration module 39 (FIG. 2). Alternatively, the user interface 36 can enable a vehicle operator or a service technician to generate a transfer function calibration request 56 (FIG. 2) as an unsolicited maintenance action, i.e., absent the transfer function update prompt 106.

While one example of the user interface 36 is provided in FIG. 3, other arrangements to convey information and accept user input are contemplated. Additional user interactions and options can be provided in support of configuration and maintenance of the vehicle 10 of FIG. 1. For instance, the user interface 36 may provide an option to revert from an updated transfer function 30A (FIG. 2) to a baseline transfer function 88 (FIG. 2) after transfer function calibration for the speaker 22A. The description region 104 may also provide instructions for establishing a preferred audio environment when performing transfer function calibration.

Figure 4:
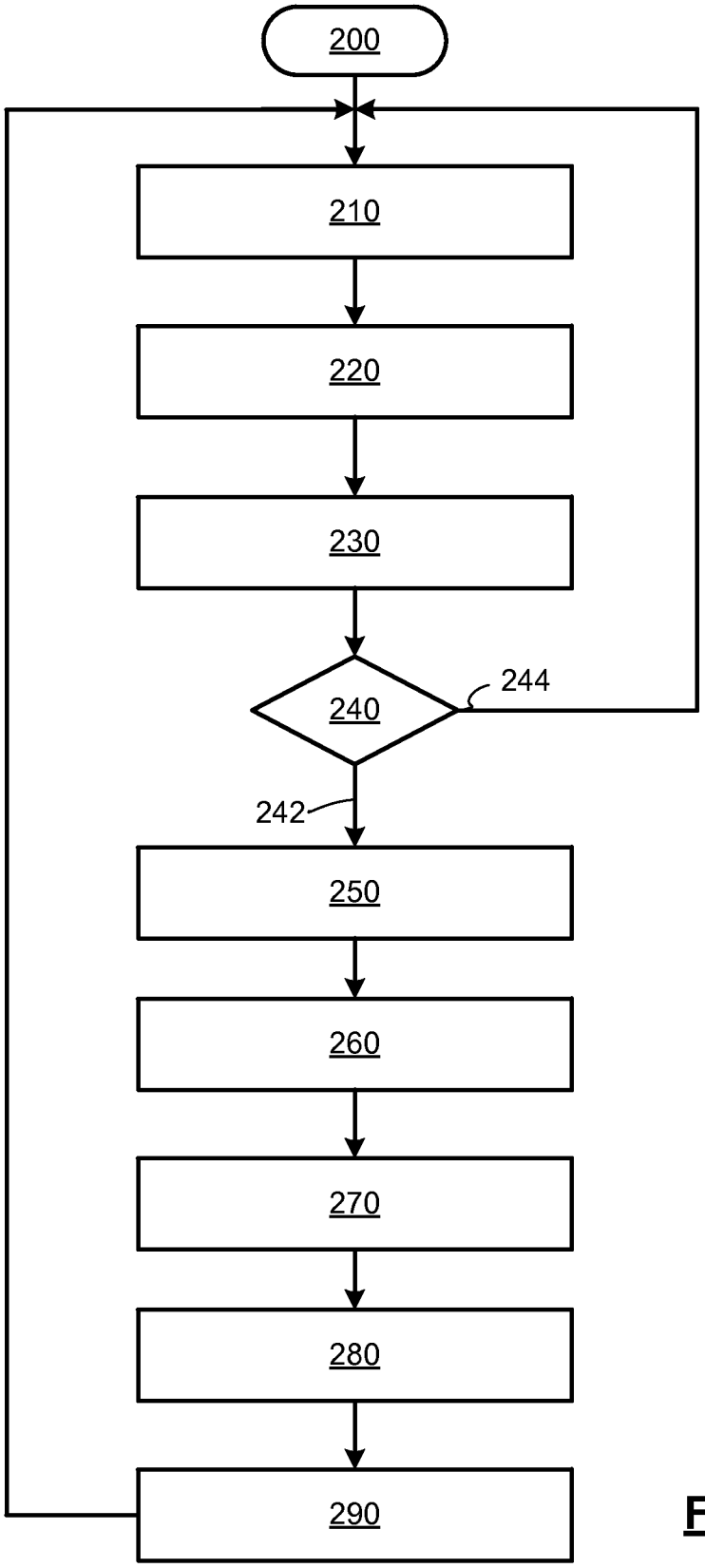
FIG. 4 is a flowchart illustrating a method in accordance with an exemplary embodiment.

Referring now to FIG. 4, and with continued reference to FIGS. 1-3, a flowchart illustrates sound augmentation system transfer function calibration methods that can be performed in the vehicle system 12 in accordance with the present disclosure. As can be appreciated in light of the disclosure, the order of operations within the method is not limited to the sequential execution as illustrated in FIG. 4, but may be performed in one or more varying orders as applicable and in accordance with the present disclosure. As can further be appreciated, one or more steps may be added or removed without altering the spirit of the method.

In one example, the method may begin at 200. At 210, the sound augmentation generator 46 of the sound augmentation system 40 produces an augmented audio output 52 to drive at least one audio output 19 based in part on a transfer function 30. As previously described, the sound augmentation system 40 can be coupled to one or more inputs such as audio input 24, and the transfer function 30 may be defined based on a pairing 28 of one audio output 19 with one audio input 24. At 220, a feedback 66 of the augmented audio output 52 is compared to a level of at least one audio input 24 to determine a current performance level 70 of the sound augmentation system 40.

At 230, a difference between the current performance level 70 and an expected performance level of the sound augmentation system 40 is determined. At 240, if the difference is at a threshold level, then path 242 is taken to 250; otherwise, path 244 loops back to 210, where the threshold level indicates that an update of the transfer function 30 is recommended. At 250, a transfer function update prompt 106 is triggered and may be displayed on the user interface 36 or otherwise conveyed as vehicle status information. At 260, the transfer function calibration module 39 monitors for a transfer function calibration request 56 in response to the transfer function update prompt 106.

At 270, in response to receiving the transfer function calibration request 56, the transfer function calibration module 39 drives a calibration sequence 41 on the at least one audio output 19 while monitoring the at least one audio input 24 to determine an updated transfer function 30A. The transfer function 30 and the updated transfer function 30A can be defined based on a pairing 28 of one of the at least one audio output 19 with one of the at least one audio input 24. The sound augmentation system 40 may be coupled to two or more instances of the pairing 28, each having a separate instance of the transfer function 30. A separate instance of the updated transfer function 30A corresponding to each instance of the transfer function 30 can be produced. The sound augmentation system health monitor 42 can identify which pairing instance resulted in the transfer function update prompt 106. At 280, the transfer function 30 is replaced by the updated transfer function 30A. An option to revert from the updated transfer function 30A to a baseline transfer function 88 may be provided via the user interface 36.

At 290, each instance of the updated transfer function 30A can be transmitted with a system identifier to the data collection system 5. The wireless interface 38 can be used to communicate with the data collection system 5 via the communication network 6.

The method of FIG. 4 can loop back to 210 and continue determining whether transfer function calibration is needed.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A vehicle system, comprising:

a sound augmentation system comprising a sound augmentation generator coupled to at least one audio output, the sound augmentation generator produces an augmented audio output to drive the at least one audio output based on a transfer function;

a sound augmentation system health monitor coupled to at least one audio input and a feedback of the augmented audio output, the sound augmentation system health monitor determines a current performance level of the sound augmentation system based on the at least one audio input and the feedback of the augmented audio output, and triggers a transfer function update prompt based on a difference between the current performance level and an expected performance level being at a threshold level;

a user interface that outputs the transfer function update prompt and receives a transfer function calibration request in response to the transfer function update prompt; and a transfer function calibration module coupled to the at least one audio output and the at least one audio input, the transfer function calibration module drives a calibration sequence on the at least one audio output and monitors the at least one audio input to determine an updated transfer function in response to the transfer function calibration request.

2. The vehicle system of claim 1, wherein the sound augmentation system is coupled to the at least one audio input, and the transfer function and the updated transfer function are defined based on a pairing of one of the at least one audio output with one of the at least one audio input.

3. The vehicle system of claim 2, wherein the vehicle system comprises two or more instances of the pairing each having a separate instance of the transfer function.

4. The vehicle system of claim 3, wherein the transfer function calibration module produces a separate instance of the updated transfer function corresponding to each instance of the transfer function.

5. The vehicle system of claim 4, wherein the sound augmentation system health monitor identifies which pairing instance resulted in the transfer function update prompt.

6. The vehicle system of claim 4, wherein each instance of the updated transfer function is transmitted with an identifier of the vehicle system to a data collection system.

7. The vehicle system of claim 1, wherein the sound augmentation system health monitor further determines the current performance level of the sound augmentation system based on a feedback of the at least one audio output.

8. The vehicle system of claim 1, wherein the transfer function is replaced by the updated transfer function, and an option to revert from the updated transfer function to a baseline transfer function is provided via the user interface.

9. A method of transfer function calibration for a sound augmentation system in a vehicle, the method comprising:

producing, by a sound augmentation generator of the sound augmentation system, an augmented audio output to drive at least one audio output in the vehicle based on a transfer function;

determining a current performance level of the sound augmentation system based on a feedback of the augmented audio output and at least one audio input;

triggering a transfer function update prompt based on a difference between the current performance level and an expected performance level being at a threshold level;

monitoring for a transfer function calibration request in response to the transfer function update prompt; and in response to receiving the transfer function calibration request, driving a calibration sequence on the at least one audio output while monitoring the at least one audio input to determine an updated transfer function.

10. The method of claim 9, wherein the sound augmentation system is coupled to the at least one audio input, and the transfer function and the updated transfer function are defined based on a pairing of one of the at least one audio output with one of the at least one audio input.

11. The method of claim 10, wherein the sound augmentation system is coupled to two or more instances of the pairing each having a separate instance of the transfer function.

12. The method of claim 11, further comprising:

producing a separate instance of the updated transfer function corresponding to each instance of the transfer function.

13. The method of claim 12, further comprising:

identifying which pairing instance resulted in the transfer function update prompt.

14. The method of claim 12, further comprising:

transmitting each instance of the updated transfer function with a system identifier to a data collection system.

15. The method of claim 9, wherein the current performance level of the sound augmentation system is further determined based on a feedback of the at least one audio output.

16. The method of claim 9, further comprising:

replacing the transfer function with the updated transfer function; and providing an option via a user interface to revert from the updated transfer function to a baseline transfer function.

17. A vehicle, comprising:

at least one audio output to a speaker;

at least one audio input from a microphone;

a sound augmentation system comprising a sound augmentation generator coupled to the at least one audio output, the sound augmentation generator produces an augmented audio output to drive the at least one audio output based on a transfer function;

a sound augmentation system health monitor coupled to the at least one audio input and a feedback of the augmented audio output, the sound augmentation system health monitor determines a current performance level of the sound augmentation system based on the at least one audio input and the feedback of the augmented audio output, and triggers a transfer function update prompt based on a difference between the current performance level and an expected performance level being at a threshold level;

a user interface that outputs the transfer function update prompt and receives a transfer function calibration request in response to the transfer function update prompt;

a transfer function calibration module coupled to the at least one audio output and the at least one audio input, the transfer function calibration module drives a calibration sequence on the at least one audio output and monitors the at least one audio input to determine an updated transfer function in response to the transfer function calibration request; and a wireless interface that transmits the updated transfer function to a data collection system.

18. The vehicle of claim 17, wherein the transfer function and the updated transfer function are defined based on a pairing of one of the at least one audio output with one of the at least one audio input, the vehicle comprises two or more instances of the pairing each having a separate instance of the transfer function, the transfer function calibration module produces a separate instance of the updated transfer function corresponding to each instance of the transfer function, the sound augmentation system health monitor identifies which pairing instance resulted in the transfer function update prompt, and each instance of the updated transfer function is transmitted with an identifier of the vehicle to the data collection system.

19. The vehicle of claim 17, wherein the sound augmentation system health monitor further determines the current performance level of the sound augmentation system based on a feedback of the at least one audio output.

20. The vehicle of claim 17, wherein the transfer function is replaced by the updated transfer function, and an option to revert from the updated transfer function to a baseline transfer function is provided via the user interface.

* * * * *